US007841680B2

(12) United States Patent
Onodera

(10) Patent No.: US 7,841,680 B2
(45) Date of Patent: Nov. 30, 2010

(54) INK JET PRINTING APPARATUS AND INK JET PRINTING METHOD

(75) Inventor: Kazuo Onodera, Yokohama (JP)

(73) Assignee: Canon Finetech Inc., Misato-shi (JP)

( * ) Notice: Subject to any disclaimer, the term of this patent is extended or adjusted under 35 U.S.C. 154(b) by 382 days.

(21) Appl. No.: 12/107,563

(22) Filed: Apr. 22, 2008

(65) Prior Publication Data

US 2008/0266345 A1 Oct. 30, 2008

(30) Foreign Application Priority Data

Apr. 26, 2007 (JP) ..... 2007-117731

(51) Int. Cl.
*B41J 29/38* (2006.01)
*B41J 2/155* (2006.01)

(52) U.S. Cl. ..... 347/13; 347/42

(58) Field of Classification Search ..... 347/13, 347/42

See application file for complete search history.

(56) References Cited

U.S. PATENT DOCUMENTS

2006/0227157 A1* 10/2006 Drake et al. ..... 347/13
2006/0256157 A1* 11/2006 Kim et al. ..... 347/47
2007/0085866 A1* 4/2007 Vladislav et al. ..... 347/9

FOREIGN PATENT DOCUMENTS

JP 2005-238556 9/2005

* cited by examiner

*Primary Examiner*—Julian D Huffman
(74) *Attorney, Agent, or Firm*—Fitzpatrick, Cella, Harper & Scinto

(57) ABSTRACT

An object of the present invention is to provide an ink jet printing apparatus and an ink jet printing method which can prevent print quality from being degraded by a non-ejection nozzle while maintaining high-speed printing performance based on a raster division method. The present invention sequentially performs, array by array, an operation of ejecting ink through a plurality of nozzle arrays to sequentially print an image in a plurality of raster forming areas of a print medium. At this time, if an expected printing result fails to be achieved owing to a nozzle included in any of the nozzle arrays which exhibits degraded ejecting performance, degrading image quality, then the ejection order of the plurality of nozzle arrays is changed. This enables a reduction in the degradation of print quality caused by the ejecting performance of the nozzles.

14 Claims, 15 Drawing Sheets

INK JET PRINTING APPARATUS AND INK JET PRINTING METHOD

BACKGROUND OF THE INVENTION

1. Field of the Invention

The present invention relates to an ink jet printing apparatus including a plurality of nozzle arrays each having a plurality of nozzles which are arranged in a direction crossing a direction in which print media are conveyed and through which ink droplets are ejected so that the nozzle arrays are used to sequentially print rasters. The present invention also relates to a relevant ink jet printing method.

2. Description of the Related Art

A printing apparatus using an methodink jet method of ejecting ink droplets through a plurality of nozzles formed in a print head is commonly used not only as a printing apparatus but also in various instruments. This printing apparatus drives ejection energy generating elements provided in the nozzles in the print head to eject ink droplets. Known ejection energy generating elements include electrothermal converting elements such as heaters and electromechanical converting elements such as piezo elements. All these elements are driven by applying electric signals (driving pulses) corresponding to print data to the elements, to eject ink droplets through the nozzles. For example, a printing apparatus using electrothermal converting elements applies a driving pulse to the electrothermal converting elements to generate thermal energy so that the thermal energy subjects ink in the nozzles to film boiling to generate bubbles. Pressure resulting from the generation of the bubbles allows ink droplets to be ejected through the nozzles.

Some of these printing apparatuses are what is called full-line printing apparatuses that perform printing using print heads (also referred to as lines heads) including long nozzle arrays each having a large number of nozzles collectively arranged over a range equal to or greater than the width of print media used. The full line printing apparatus allows each of the line heads to simultaneously form a single raster line, and is thus suitable for high-speed printing. As a printing apparatus using line heads, Japanese Patent Laid-Open No. 2005-238556 discloses a printing apparatus having a plurality of full line heads ejecting ink of the same color and arranged along a direction in which print media are conveyed.

The printing apparatus disclosed in Japanese Patent Laid-Open No. 2005-238556 uses data on an image of the same color to form the image so that the line heads sequentially form the respective rasters. The printing apparatus can print the image faster than printing apparatuses using a single full line head. Furthermore, this printing apparatus adopts a divided image method in which in forming a single image, the different print heads are responsible for the respective rasters for printing. Thus, even if any nozzle becomes defective, that is, ink cannot be normally ejected through the nozzle owing to, for example, contaminants attached thereto, the divided image method enables a reduction in the adverse effects of the defective nozzle on print quality. That is, dots preceding and succeeding (in a column direction) an area in which a dot is to be formed by the defective nozzle are printed by nozzles in another print head. This enables a reduction in the adverse effects of the defective nozzle compared to the case in which each column is always printed by the same nozzle.

However, two or more nozzles in each of the adjacent print heads which are responsible for the same column may all become defective. In this case, two or more consecutive areas in which the dots are otherwise formed are blank. Then, the print quality may be significantly degraded.

In contrast, it is possible to allow the area that is otherwise printed by the defective nozzles to be printed by nozzles in another print head which are responsible for the same column as that for which the defective nozzles are responsible, in order to complement the printing of the area. However, in this case, to increase the frequency with which the appropriate nozzle array is used, it is necessary to set a longer driving period for the nozzle array. As a result, high-speed printing performance, which is characteristic of the divided printing method, is not sufficiently achieved.

SUMMARY OF THE INVENTION

The present invention is provided in view of the above-described problems. An object of the present invention is to provide an ink jet printing apparatus and an ink jet printing method which can prevent the print quality from being degraded by a non-ejection nozzle while maintaining the high-speed printing performance based on the raster division method.

To accomplish this object, the present invention is configured as described below.

A first aspect of the present invention provides an ink jet printing apparatus having a plurality of nozzle arrays arranged along a conveying direction in which a print medium is conveyed, each of the nozzle arrays having a plurality of nozzles which are arranged in a crossing direction crossing the conveying direction and through which ink droplets are ejected, the apparatus sequentially printing an image in a plurality of raster forming areas set on the print medium in the crossing direction by sequentially performing an operation of ejecting ink through the plurality of nozzle arrays, the apparatus comprising ejection order changing means for changing an ejection order of the plurality of nozzle arrays according to ejecting performance of each of nozzles included in each of the nozzle arrays.

A second aspect of the present invention provides an ink jet printing method using a plurality of nozzle arrays arranged along a conveying direction in which a print medium is conveyed, each of the nozzle arrays having a plurality of nozzles which are arranged in a crossing direction crossing the conveying direction and through which ink droplets are ejected, the method sequentially printing an image in a plurality of raster forming areas set on the print medium in the crossing direction by sequentially performing an operation of ejecting ink through the plurality of nozzle arrays, wherein an ejection order of the plurality of nozzle arrays in changed according to ejecting performance of each of nozzles included in each of the nozzle arrays.

The present invention changes the ejection order of the plurality of nozzle arrays according to the ejecting performance of each of the nozzles included in each of the nozzle arrays. This enables a reduction in the adverse effects of a non-ejection nozzle on the image. That is, if a plurality of nozzles responsible for a plurality of areas in the print medium which are adjacent to each other in the conveying direction are all defective, the ejection order of the nozzle arrays is changed. This makes it possible to avoid the situation in which the consecutive areas in the conveying direction are printed by the defective nozzles.

This in turn enables a reduction in the degradation of the print quality by the defective nozzles.

Further features of the present invention will become apparent from the following description of exemplary embodiments (with reference to the attached drawings).

DESCRIPTION OF THE EMBODIMENTS

An embodiment of the present invention will be described with reference to the drawings.

In the present embodiment, description will be given, by way of example, of a case in which the present invention is applied to a full line ink jet printing apparatus (hereinafter simply referred to as a printing apparatus) in which a plurality of print heads ejecting ink of the same color are juxtaposed.

Figure 1:
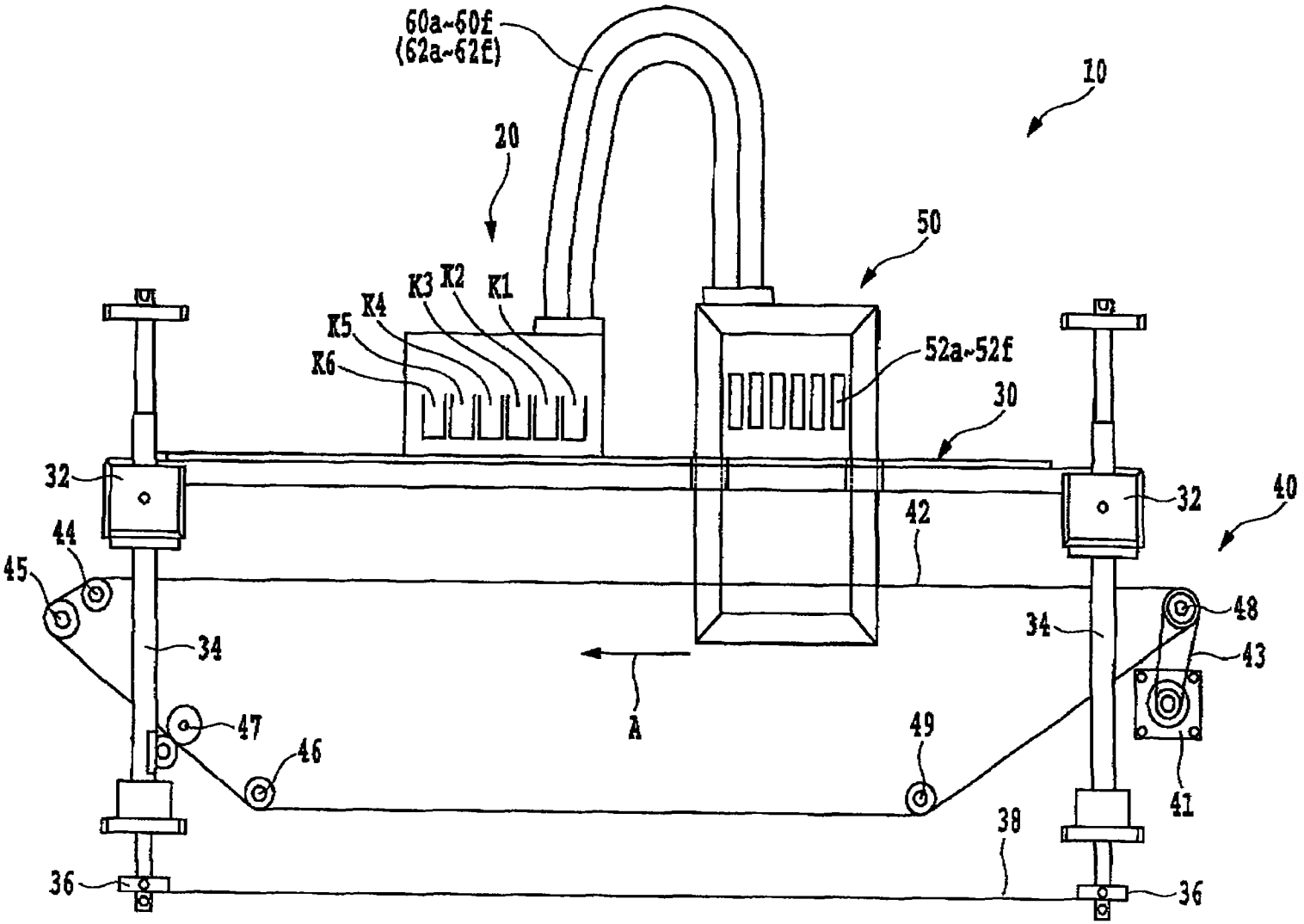
FIG. 1 is a front view schematically showing the configuration of a full line ink jet printing apparatus in which a print module is incorporated, the print module being an example of an image forming device to which the present invention is applied.
Figure 2:
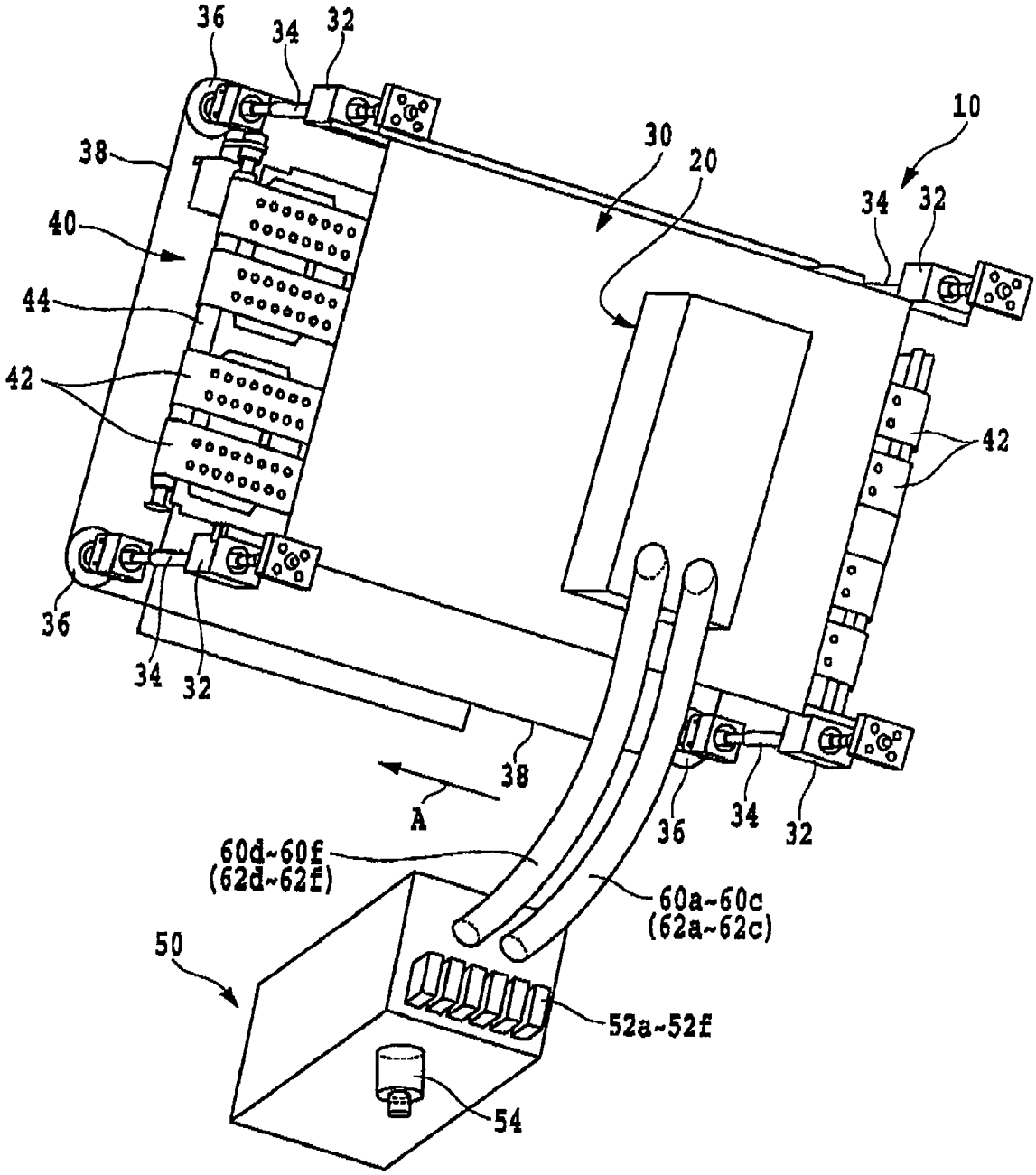
FIG. 2 is a perspective view schematically showing the configuration of the printing apparatus shown in FIG. 2.

First, with reference to FIGS. 1 and 2, description will be given of the configuration of the full line ink jet printing apparatus, an example of the printing apparatus according to the present invention. FIG. 1 is a front view schematically showing the configuration of the printing apparatus in which a print module is incorporated. FIG. 2 is a perspective view schematically showing the configuration of the printing apparatus in FIG. 1.

The printing apparatus 10 comprises a print head unit 20 in which a plurality of print heads ejecting ink to print media such as print sheets to form images are mounted parallel to one another, and a conveying unit 40 that conveys print media in the direction of arrow A (print medium conveying direction). Six line heads K1, K2, K3, K4, K5, and K6 are mounted in the print head unit 20 according to the present embodiment. All the line heads K1, K2, K3, K4, K5, and K6 eject black ink. The print head unit 20 comprises, for example, a head up down motor 118 (see FIG. 5) that moves each of the print heads K1 to K6 between a cap position and a print position and a wipe position. The print head unit 20 is fixed to a plate-like engine base 30 and elevates and lowers together with the engine base 30 as described below.

The engine base 30, to which the print head unit 20 is fixed, is rectangular. The four corners of the engine base 30 are fixed to nuts 32. Each of the nuts 32 is fitted around a threaded shaft. The threaded shaft 34 rotates to elevate and lower the nuts 32. A sprocket 36 is fixed to the bottom of each of the four threaded shafts 34. A chain 38 is placed around the four sprockets 36. The chain is rotated by a driving motor (not shown) to rotate the threaded shafts 34 in synchronism. The print head unit 20 thus elevates and lowers together with the engine base 30.

The conveying unit 40 comprises four conveying belts 42 that allow a print medium to pass below the print head unit 20. The conveying belt 42 is placed around driven rollers 44, 45, and 46, an encoder roller 47, and a driving roller 48, and tensed by a tensioner 49. The conveying belt 42 is revolved in the print medium conveying direction (the direction of arrow A) by allowing a timing belt 43 revolved by a driving motor 41 to rotate the driving roller 48.

The printing apparatus 10 comprises an ink supply unit 50 that supplies ink to the print head unit 20. Sub-tanks 52*a* to 52*f*, an ink tank 53*a* and others (see FIG. 4) are arranged inside the ink supply unit 50; ink to be supplied to print heads K1 to K6 is stored in the sub-tanks 52*a* to 52*f*, and ink to be supplied to the sub-tanks 52*a* to 52*f* is stored in the ink tank 53*a* and others. The ink stored in the sub-tank 52*a* is supplied to the print head K1, and the ink stored in the sub-tank 52*b* is supplied to the print head K2. The ink in the other sub-tanks is similarly supplied to the corresponding print heads.

Each of the ink tanks is connected to the corresponding one of the sub-tanks 52*a* to 52*f* by a tube 56 (see FIG. 4) so that ink is fed from each of the ink tank 53*a* and others to the corresponding one of the sub-tanks 52*a* and others. An ink channel member composed of a bundle of ink supply tubes 60*a* to 60*f* and ink return tubes 62*a* to 62*f* is connected between the ink supply unit 50 and the print head unit 20. The ink fed from each of the sub-tanks 52*a* to 52*f* to the corresponding one of the print heads K1 to K6 flows through the corresponding one of the ink supply tubes 60*a* to 60*f*. The ink returning from each of the print heads K1 to K6 to the corresponding one of the sub-tanks 52*a* to 52*f* flows through the corresponding one of the ink return tubes 62*a* to 62*f*. A recovery unit 22 (see FIG. 4) is incorporated in the print head unit 20 to recover the condition of ink ejection from the print heads K1 to E6 to the initial one.

Figure 3:
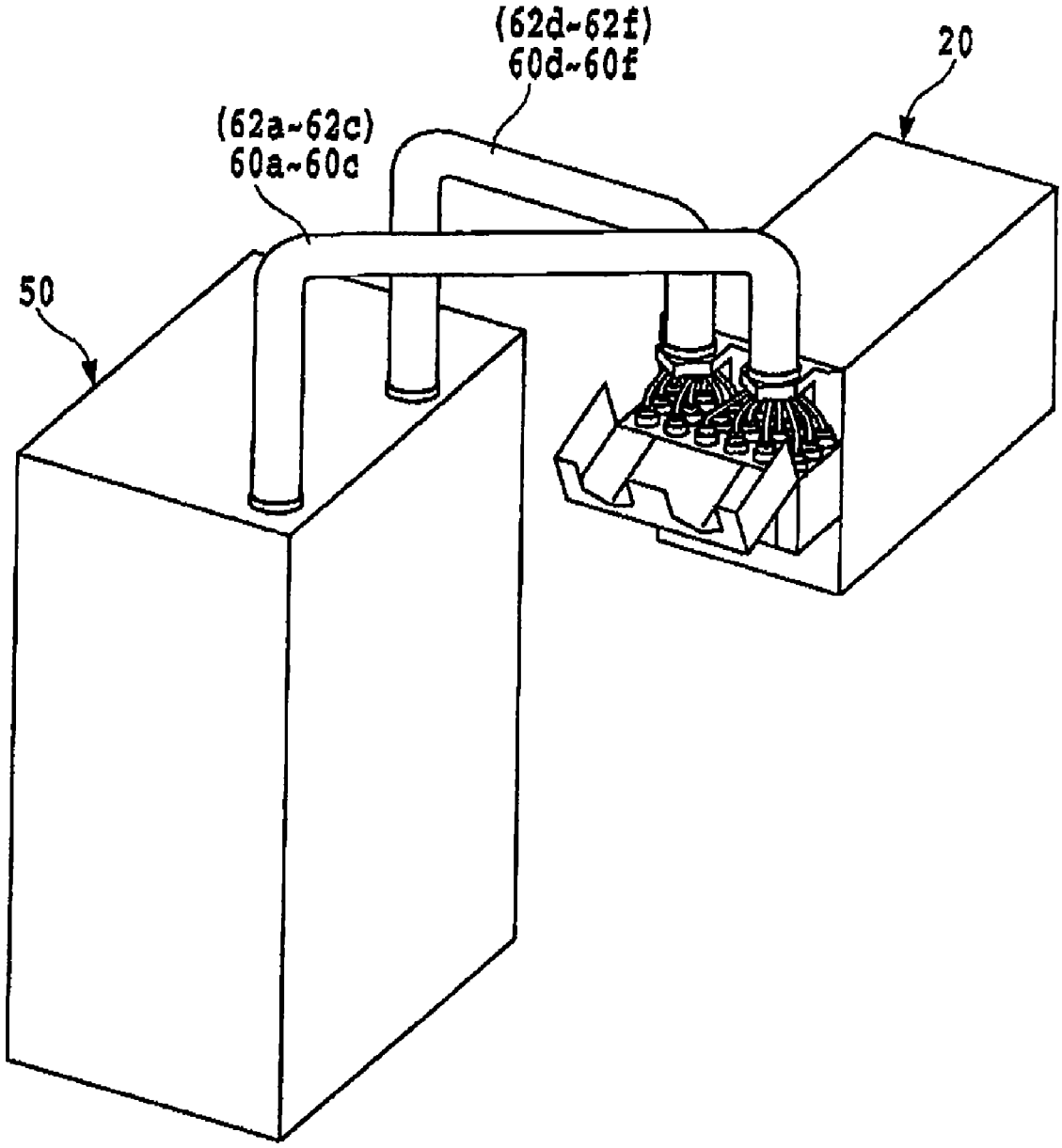
FIG. 3 is a perspective view showing ink supply tubes and ink return tubes connecting a print head unit and an ink supply unit together.

With reference to FIG. 3, description will be given of the connection between the print head unit 20 and the ink supply unit 50. FIG. 3 is a perspective view of the ink supply tubes and ink return tubes connecting the print head unit 20 and the ink supply unit 50 together.

Figure 5:
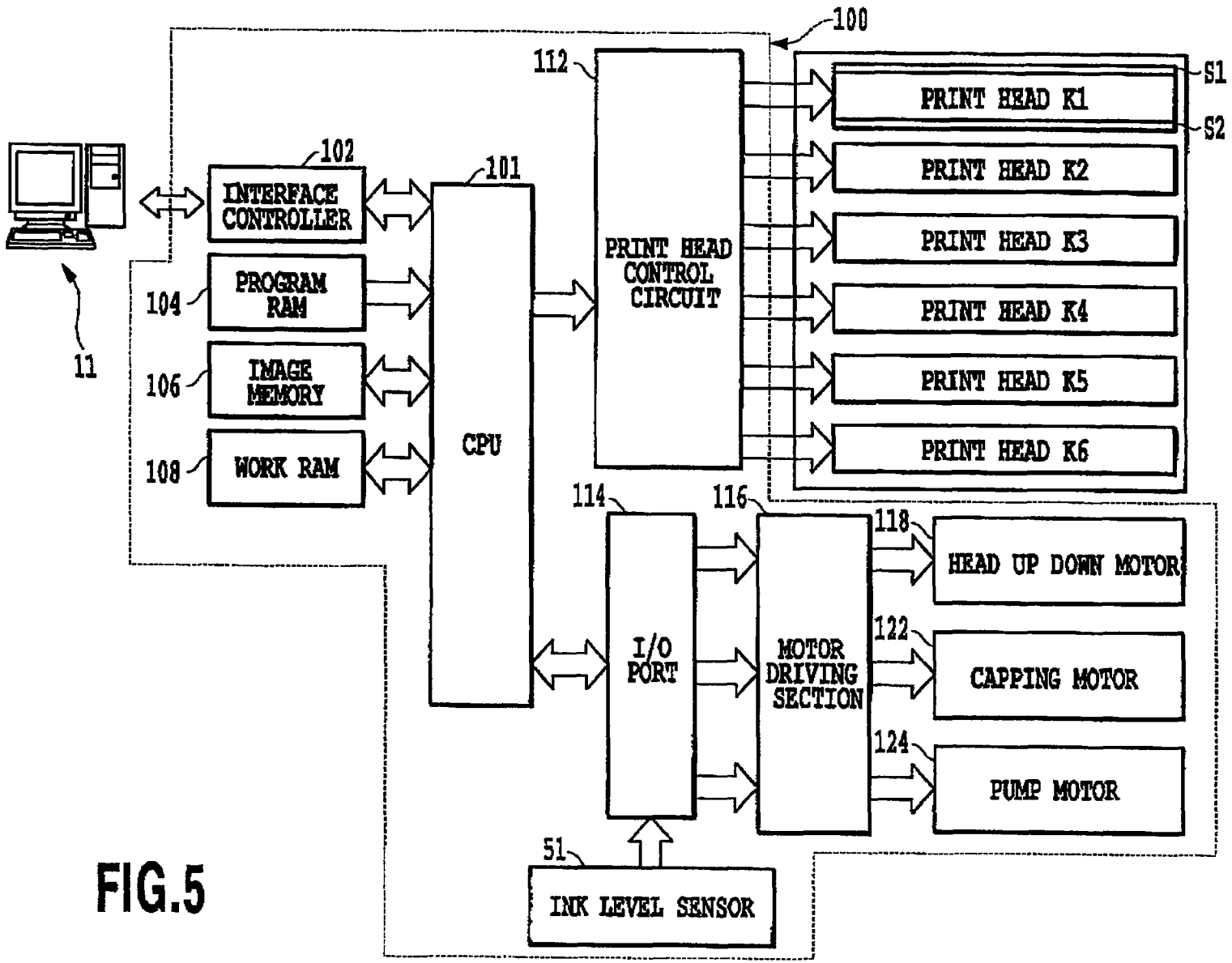
FIG. 5 is a block diagram showing the configuration of a control system in the printing apparatus shown in FIG. 1.

The print head unit 20 and ink supply unit 50 integrally connected together by the tubes is called a print module. A control system described with reference to FIG. 5 is incorporated in the print module. The print head unit 20 comprises a plurality of print heads having nozzles which are arranged over a width equal to or larger than the maximum width of print media used and through which the ink is ejected. The nozzle described in the specification and claims refers to an ejection port through which ink droplets are ejected, an ink channel that is in communication with the ejection port, and an electrothermal converting element provided in the ink channel. However, in the drawings, the ejection port is shown as a part of the nozzle. Each of the print heads K1 to K6 have a nozzle array arranged in a direction orthogonal to the print medium conveying direction (the direction of arrow A in FIG. 2). The print heads K1 to K6 are parallel to one another.

To form an image, each of the print heads K1 to K6 ejects ink from an upstream side in the print medium conveying direction (upstream in the direction of arrow A). The ink supply unit 50 is located away from the print head unit 20. The sub-tanks 52*a* to 52*f* in the ink supply unit 50 are connected to the respective print heads K1 to K6 in the print head unit 20 by the respective ink supply tubes 60*a* to 60*f* and ink return tubes 62*a* to 62*f*.

Figure 4:
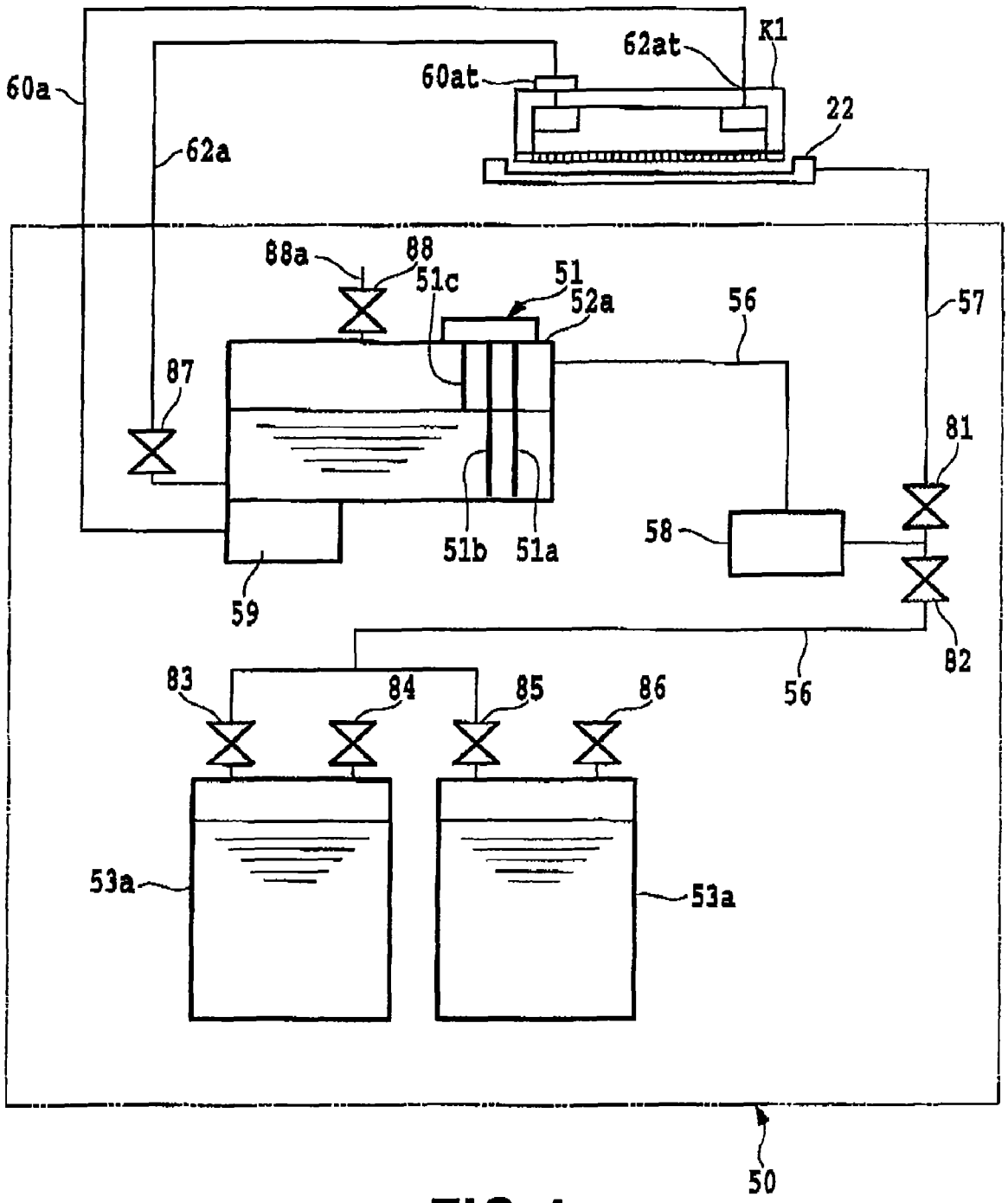
FIG. 4 is a schematic diagram showing ink channels formed between the print head unit and the ink supply unit.

With reference to FIG. 4, description will be given of the ink channels between the print head unit 20 and the ink supply unit 20.

FIG. 4 is a schematic diagram showing the ink channels formed between the print head unit 20 and the ink supply unit 20. Here, the print head K1 and the sub-tank 52*a* will be described by way of example. However, the other print heads K2 to K6 have a similar configuration.

The ink tank 53*a*, in which black ink is stored, is connected to the sub-tank 52*a* by the ink suction tube 56. A suction pump 58 is located in the middle of the ink suction tube 56 to suck the ink from the ink tank 53*a* and feed the ink into the sub-tank 52*a*. In the condition shown in FIG. 4, valves 81 and 85 are closed and valves 82, 83, and 84 are opened to drive the suction pump 58 to suck the ink from the ink tank 53*a* and feed the ink into the sub-tank 52*a*. Two sets of the ink tank 53*a* are mounted so as to prevent the ink from being exhausted during printing. When the ink in one of the ink tanks 53*a* is exhausted, the valves 83, 84, 85, and 86 are appropriately switched to connect the ink suction tube 56 to the other ink tank 53*a*.

The inside of the sub-tank 52*a* is connected to an atmosphere communication hole 88*a*. The valve 88 is opened to allow the inside of the sub-tank 52*a* to communicate with the atmosphere, setting the inside to the atmospheric pressure. An ink level sensor 51 comprising electrodes 51*a*, 51*b*, and 51*c* is mounted on the sub-tank 52*a* to sense the presence or absence of ink as well as the level of the ink. The ink level in the sub-tank is controlled on the basis of variations of electric resistances between the electrodes 51*a*, 51*b*, and 51*c* so as to maintain the ink level constant. The sub-tank 52*a* and the print head K1 are positioned so as to exert an appropriate negative pressure on the nozzles in the print head K1 on the basis of a head difference.

The sub-tank 52*a* and the print head K1 are connected together by the ink supply tube 60*a* and the ink return tube 62*a* so that the ink can be circulated between the sub-tank 52*a* and the print head K1. The sub-tank 52*a* and the ink supply tube 60*a* are connected together via the ink supply pump 59. The ink supply pump 59 is driven to feed the ink in the sub-tank 52*a* to the print head K1. The recovery unit 22 is positioned below the print head K1 to receive the ink pushed out from the print head K1. The recovery unit 22 and the sub-tank 52*a* are connected together by an ink recovery tube 57 and a part of the ink suction tube 56. The valve 82 to closed and the valve 81 is opened to drive the suction pump 58 to transfer the ink received by the recovery unit 22 to the sub-tank 52*a*.

A control system 100 in the printing apparatus 10 will be described with reference to FIG. 5.

FIG. 5 is a block diagram showing the configuration of the control system in the printing apparatus 10. The control system it built in the print module as described above.

Print data and commands transmitted to the control system 100 by a host apparatus 11 such as a computer are received by a CPU 101 via an interface controller 102. The CPU 101 is an arithmetic processing device that generally controls operations of printing and receiving print data which are performed by the printing apparatus 10. The CPU 101 also functions as determining means according to the present invention. The CPU 101 analyzes a received command and then develops the image data in the form of a bit map in an image memory 106 serving as an image developing section. As an operational process before printing, the CPU 101 drives a capping motor 122 and a head up down motor 118 via an I/O port 114 and a motor driving section 116 to move the print heads K1 to K6 away from the cap 22 (see FIG. 4) to a print position.

Subsequently, the driving motor 41 is driven to start an operation of revolving the conveying belt 42. A print medium placed on the conveying belt is conveyed toward the print heads K1 to K6. In this case, when a leading end sensor (not shown) senses the leading end of the print medium, the CPU 101 receives a detection signal from the leading end sensor to determine a timing (print start timing) at which ink ejection is started. Then, on the basis of an output signal from an encoder roller 47 (see FIG. 1), the CPU 101 sequentially reads print data from the image memory 106 in synchronism with the conveyance of the print medium. The CPU 101 then transfers the read data to the print heads K1 to K6 via a print head control circuit 112.

Such operations of the CPU 101 are performed on the basis of process programs stored in a program ROM 104. The program ROM 104 stores process programs and tables corresponding to control flown. A work RAM 10 is also used as a work memory. To perform an operation of cleaning or recovering the print heads K1 to K6, the CPU 101 drives a pump motor 124 via the I/O port and the motor driving section 116 to control pressurization, suction, and the like of the ink.

On the basis of a print horizontal synchronization signal synchronizing with the conveyance of the print medium, the CPU 101 divides the print data into pieces for respective rasters and appropriately arranges and stores the respective raster data into the image memory 106 as data to be printed by the six print heads K1 to K6 as described below. When the CPU 101 receives the horizontal synchronization signal, the print data for one raster stored in image memory is transmitted to the print head control circuit 112. On the basis of the transmitted print data, the print head control circuit 112 ejects the ink to the print medium through the corresponding print head to form an image as described below.

Figure 6:
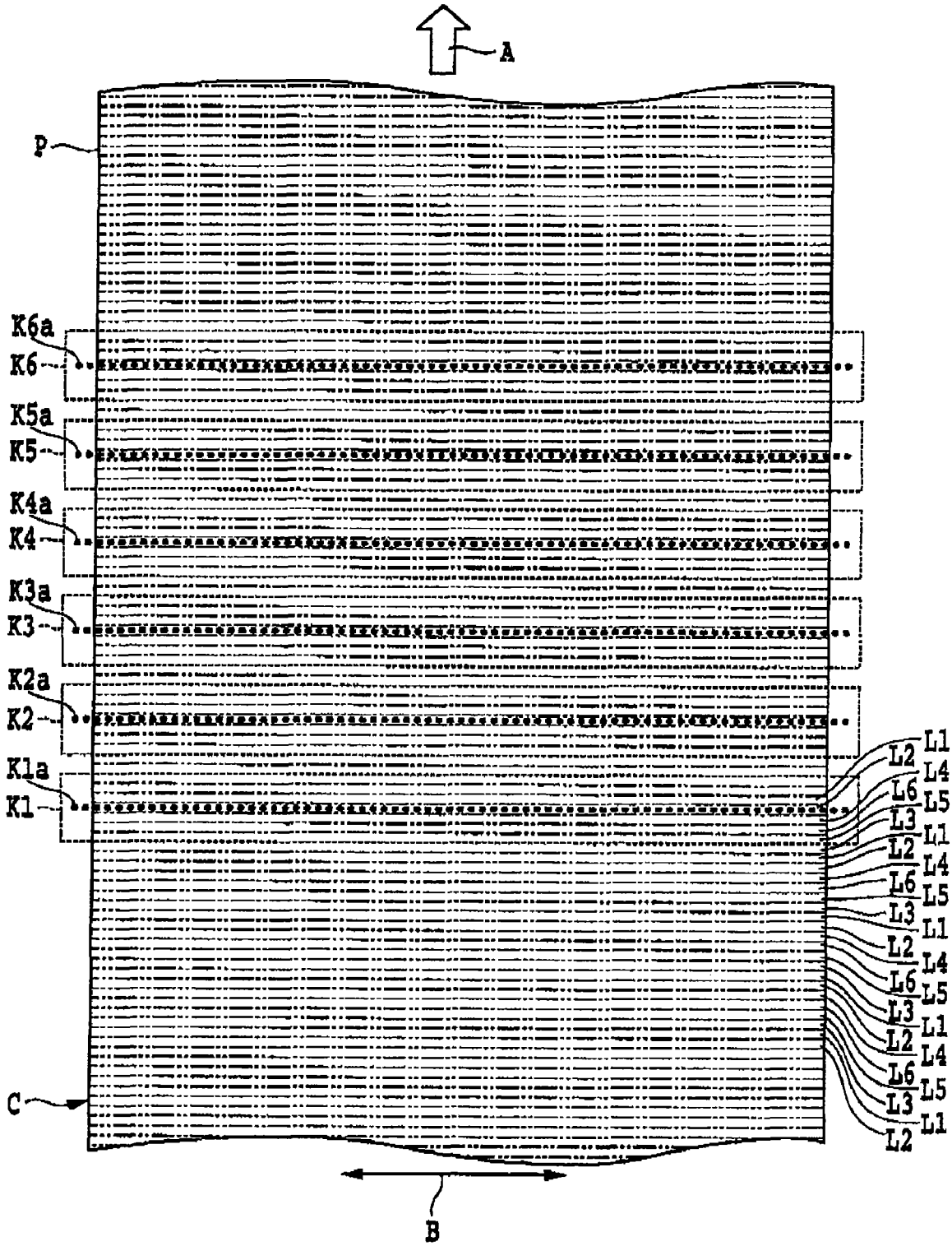
FIG. 6 is a plan view schematically showing the positional relationship between a print head located above a conveying path for print media and nozzles (ejection ports) in the print head and a print medium.
Figure 7:
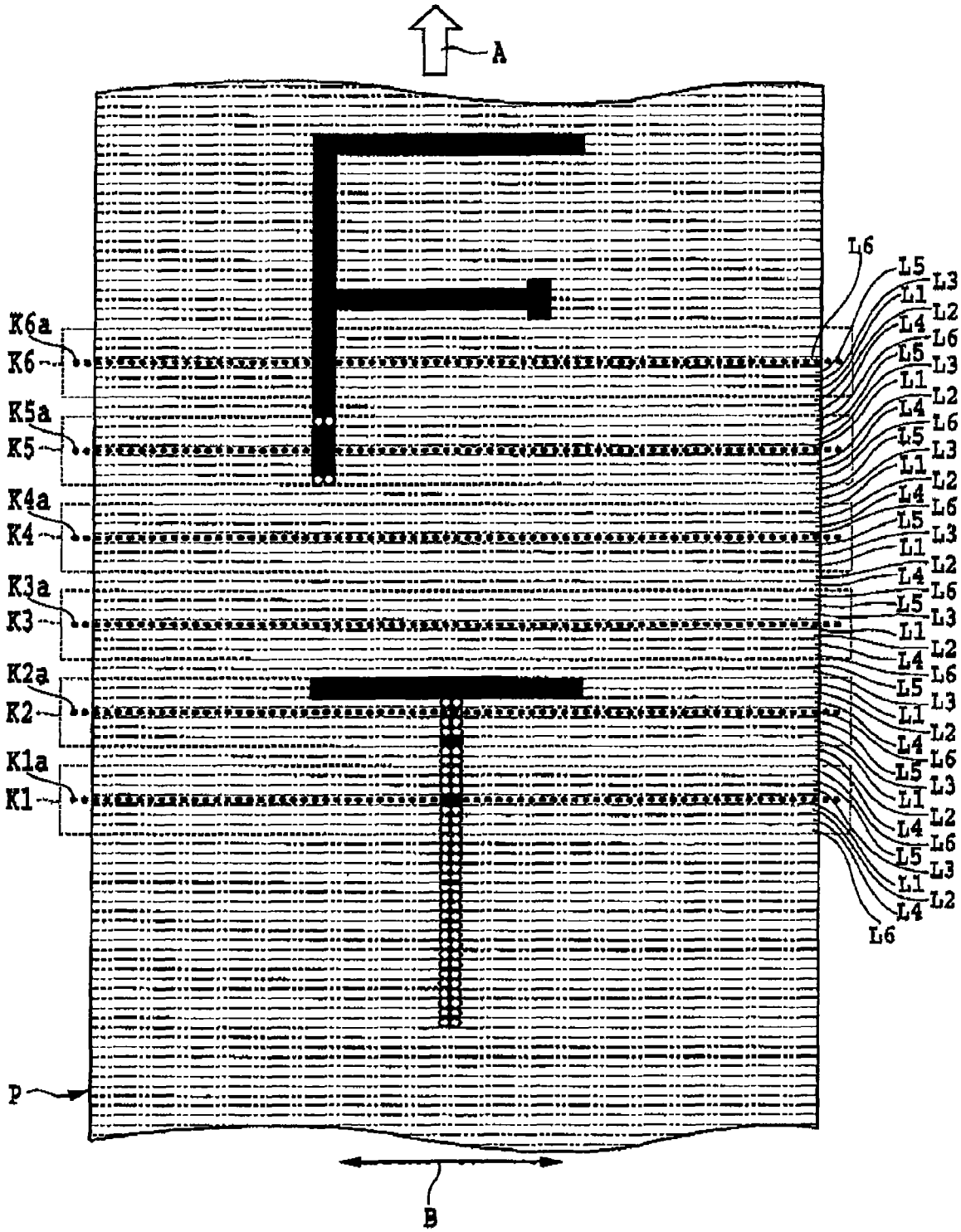
FIG. 7 is a plan view schematically showing that an image is being formed on the print medium.
Figure 8:
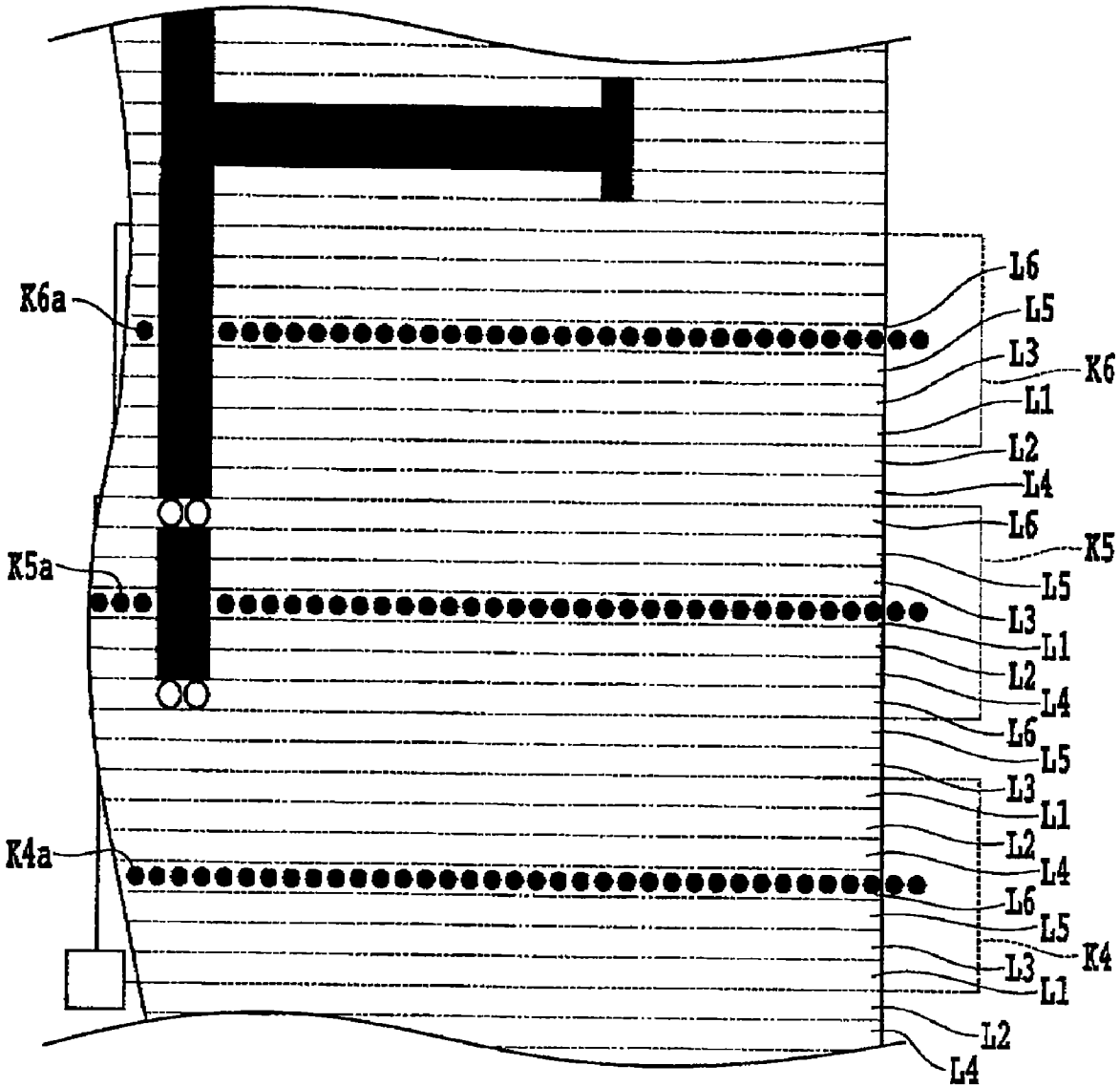
FIG. 8 is an enlarged view of a part of FIG. 7.

With reference to FIGS. 6 to 8, description will be given of a method of forming an image under the control of the control system 100, described above.

FIG. 6 is a plan view schematically showing the positional relationship between the print head located above the conveying path for the print-medium, the nozzles (ejection ports) in the print head, and the print medium. FIG. 7 is a plan view schematically showing that an image is being formed on the print medium. FIG. 8 is an enlarged view of a part of FIG. 7.

A print medium P (roll paper or cut paper) being conveyed in the direction of arrow A by the conveying unit 40 (see FIG. 1 and others) has virtually set raster forming areas L1 to L6 extending in a direction (an example of a crossing direction according to the present invention; the direction of arrow B) orthogonal to the conveying direction. The raster forming areas L1 to L6 are repeatedly arranged in a given order along the conveying direction. Here, each of the raster forming areas L1 to L6 are set to repeat an interval of 5 raster areas. For example, five raster lines L5, L3, L1, L2, and L4 are set between two raster lines L6. Five raster lines L3, L1, L2, L4, and L6 are set between two raster lines L5. In FIG. 6, the boundary line between adjacent raster forming areas (for example, L5 and L3) is expressed by an alternate long and two short dashes line. However, in actuality, such a boundary line is not drawn on the print medium P. Furthermore, one raster forming area is an area of an image which is printed on the basis of image data for one raster. For description, in the figures, the raster forming areas L1 to L6 are drawn so as to be visible. However, to actuality, the raster forming areas L1 to L6 are very narrow, and each raster area is thus difficult to see.

Each raster forming area is composed of a plurality of areas (pixels) which are arranged on the print medium in the orthogonal direction (direction of arrow B). Each of the area is an area in which an image (hereinafter also referred to as a dot) is printed by one ink droplet ejected through one nozzle. Each of the mix print heads K1 to K6 is responsible for one raster forming area. The print head responsible for one raster line simultaneously ejects the ink through those of the plurality of nozzles forming the nozzle array which are selected on the basis of the image data, to print the image in the corresponding raster forming area.

Which of the six print heads K1 to K6 is responsible for each of the raster forming areas L1 to L6 can be optionally set. Here, the print head K1 is responsible for the raster forming area L1, and the print head K2 is responsible for the raster forming area L2. Similarly, the print head K3 is responsible for the raster forming area L3, and the print head K4 is responsible for the raster forming area L4. The print head K5 is responsible for the raster forming area L5, and the print head K6 is responsible for the raster forming area L6. Thus, for each of the print heads, when a raster forming area of the print medium being conveyed for which the print head is responsible reaches a position located immediately below the print head, the print head ejects the ink to that raster area. That is, when the raster forming area L1 of the print medium P being convoyed reaches the position located immediately below the print head K1, the ink is ejected toward the raster forming area L1 through the nozzle array in the print head K2. When the raster forming area L2 reaches the position located immediately below the print head K2, the ink is ejected toward the raster forming area L2 through the nozzle array in the print head K2. This also applies to the raster forming areas L3 to L6.

The six print heads K1 to K6 in the printing apparatus 10 extend in the above-described orthogonal direction (the direction of arrow B) as shown in FIGS. 6 and 7. In each of the print heads K1 to K6, a plurality of nozzles (shown by black circles in the figures and denoted by K1*a*, K6*a*, and the like) are arranged in a line in the direction of arrow B so as to form a nozzle array. The print head control circuit 112 (see FIG. 5) is controlled so as to selectively eject the ink through the nozzles constituting the nozzle array in each of the print heads K1 to K6.

In the above example, one nozzle array is formed in each print head. However, one print head in which six nozzle arrays are formed may be used or three print heads in each of which two nozzle arrays are formed may be used.

As described above, print data on an image to be printed on the print medium is divided into a plurality of rasters by the CPU 101. The term "raster" as used herein refers to a set of pixels (dots) formed by ejecting ink droplets to pixels arranged in a line (these pixels correspond to a raster forming area); the raster generally refers to dots arranged in a line in a transverse direction (the direction orthogonal to the print medium conveying direction).

The term "raster division" as described below refers to the association of image data for each of the plurality of rasters constituting the image with one of the print heads K1, K2, K3, K4, K5, and K6. Here, the CPU 101 performs the raster division to assign data to be printed by the six print heads K1 to K6, to the respective print heads. The resulting assignment is stored in the image memory 106. When the host apparatus 11 sends image data to the printing apparatus 10, a driver or the like (not shown) in the host apparatus 11 may divide the image into rasters and send the rasters to the printing apparatus 10.

Here, description will be given of the case in which the printing apparatus configured as described above is used to allow the print heads K1 to KG to form an image "FT" shown in FIG. 7.

The image "FT" is subjected to the raster division by the CPU 101 so as to be divided into pixel printing areas (raster forming areas) arranged in a line in the direction of arrow B. The print data for each raster (the data is hereinafter referred to as raster data) is assigned to any one of the six print heads K1 to K6 so as to be printed by this print head, with the resulting assignment stored in the image memory 106. Then, at a timing when each of the virtual raster forming areas L1 to L6 on the print medium P reaches the position located immediately below the corresponding one of the print heads K1 to K6 (immediately below the nozzle line), the ink is ejected through the nozzle array in that print head.

In the condition shown in FIG. 7, the raster forming area L1 has reached the position located immediately below the print head K1. In this case, since the raster forming area L6 has also reached the position located immediately below the print head K6, the ink is ejected from both the print heads K1 and K5. In contrast, areas not associated with the other print heads K2, K3, and K5 have reached at the positions immediately below these print heads. That is, the raster forming area L6 has reached the position located immediately below the print head K2. The raster forming area L1 has reached the position located immediately below the print head K3. The raster forming area L6 has reached the position located immediately below the print head K4. The raster forming area L1 has reached the position located immediately below the print head K5. Consequently, no ink is ejected from the print heads K2, K3, K4, and K5.

The raster forming area reaching the position located each of the print heads K1 to K6 varies from hour to hour in association with the conveyance of the print medium P. The CPU 101 determines for each of the print heads K1 to K6 whether or not the corresponding raster forming area has reached the position immediately below the corresponding print head. A control system allows the nozzles in the nozzle array to selectively eject ink onto the print medium on the basis of the print data for one raster. The term "print data" as used herein refers to data including ejection data allowing the ink to be ejected through the appropriate nozzles and data preventing the ink from being elected (non-ejection data). The ejection data is used to allow the ink to be ejected through the appropriate nozzles.

The printing apparatus according to the present embodiment has a defective-nozzle detecting device (ejection capability detecting means) located on each side of the print head K1 in order to detect a non-ejection nozzle present in the print head.

The defective nozzle detecting device is composed of a light emitting section S1 and a light receiving section S2 (see FIG. 5) provided on the respective sides of the print head K1 (the upstream and downstream sides in the print medium conveying direction) and the CPU 101, to which the light emitting section S1 and the light receiving section S2 are connected. The light emitting section S1 and the light receiving section (light sensor) S2 have light emitting elements and light receiving elements arranged in association with the nozzles in the print head K1. The light emitting elements emit light toward the pixels for which the nozzles are responsible. The light receiving elements receive reflected light from the pixels on which the light from the light emitting elements has impinged. The light receiving elements transmit outputs corresponding to the quantity of light received to the CPU 101.

To detect a defective nozzle, all the nozzles in the print head to be subjected to the detection are driven to form an image (solid image pattern) extending in the conveying direction is formed on the print medium. Then, the print medium with the image formed thereon is conveyed backward. The image is irradiated with light from the light emitting elements, and the light receiving elements receive the resultant reflected light. In this case, if ink droplets from the nozzles have appropriately landed on the print medium, only a small quantity of the light emitted by the light emitting elements reaches the light receiving section. The output from each of the light receiving element is equal to or smaller than a predetermined threshold. In contrast, if the nozzle array includes a defective nozzle that fails to allow an ink droplet to land on the appropriate position on the print medium, the ink is not attached to the column area corresponding to the defective nozzle. Light from the corresponding light emitting element is reflected by the print medium and enters the corresponding light receiving element. Thus, the output from the light receiving element exceeds the predetermined threshold. Consequently, the CPU 101 determines whether or not the output from each of the light receiving element is equal to or smaller than the threshold and thus whether or not each of the nozzles is in the appropriate ejection condition. This detecting operation is repeatedly performed on each of the print heads to allow any non-ejection nozzle to be automatically detected in all the print heads.

The method of detecting a defective nozzle is not limited to the automatic detection using the light emitting section S1 and light receiving section S2 provided in each of the print heads, as is the case with the present embodiment. Any other method may be used for the detection. For example, a non-ejection nozzle can also be determined by allowing the print heads to print respective solid test patterns at different positions on the print medium and visually checking how the test patterns have been printed. A defective nozzle can also be determined by using an optical sensor provided separately from the printing apparatus to detect the result of printing by each print head. The detection of a defective nozzle described above may be performed by a user of the printing apparatus. However, the manufacturer may detect a defective nozzle before shipment and store the detection results in the RAM in the control system.

Now, with reference to FIGS. 9 to 12, description will be given of degradation of the print quality caused by the presence of a non-ejection nozzle.

First, description will be given of the relationship between the pixels set on the print medium and the printed dots. In the present embodiment, a pixel means a square area which is virtually set on the print medium and which is landed on by one ink droplet ejected through the nozzle. If the pixel has a density of 600 dpi×600 dpi (dpi: dots per inch), each side of the pixel is about 42.3 μm in length. In contrast, an ink droplet ejected from the print head forms a circular image upon landed on the print medium. Thus, to reliably fill in the pixel (A1) by means of one ink ejection (one ink droplet), it is necessary to form a dot of diameter about 60 μm as shown at A2 in FIG. 9.

On the basis of the relationship between the dote and the pixels described above, description will be given, with reference to FIG. 10, of the degradation of an image resulting from inappropriate printing caused by non-ejection nozzles when areas to be printed are consecutively arranged.

Figure 9:
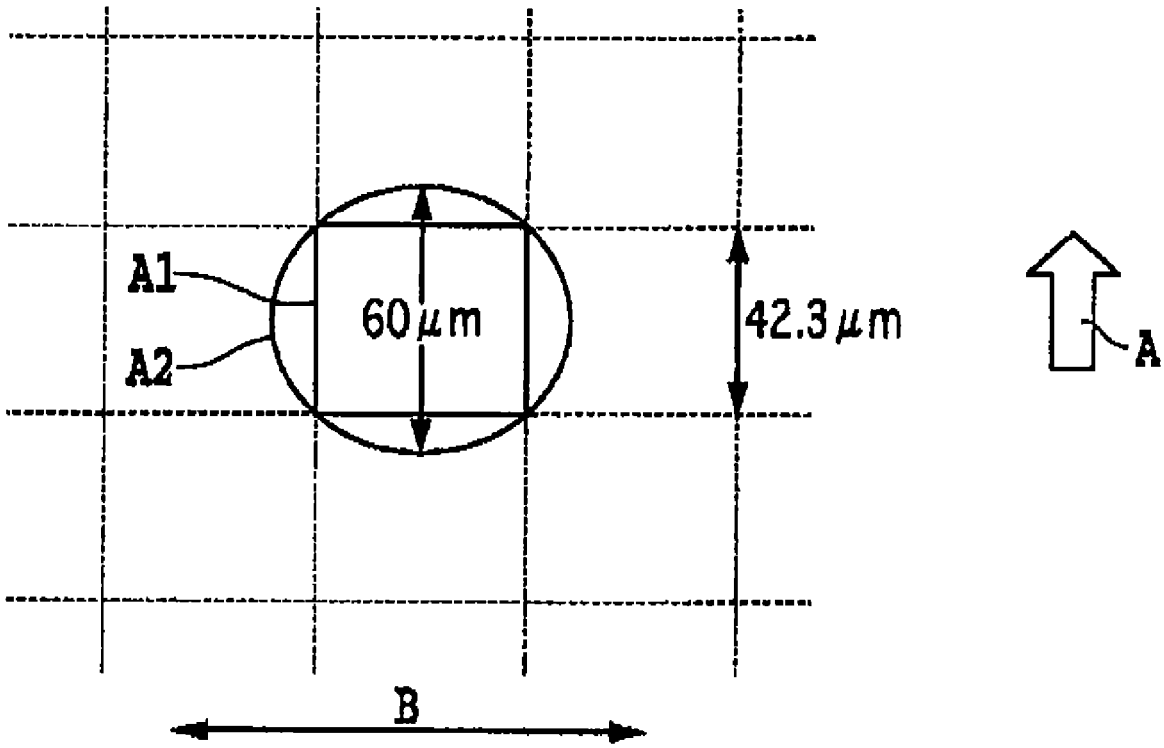
FIG. 9 is a plan view showing an area (pixel) that is to be filled in with one ink droplet and the diameter of a dot to be formed in order to reliably fill in the pixel by means of one ink ejection.
Figure 10:
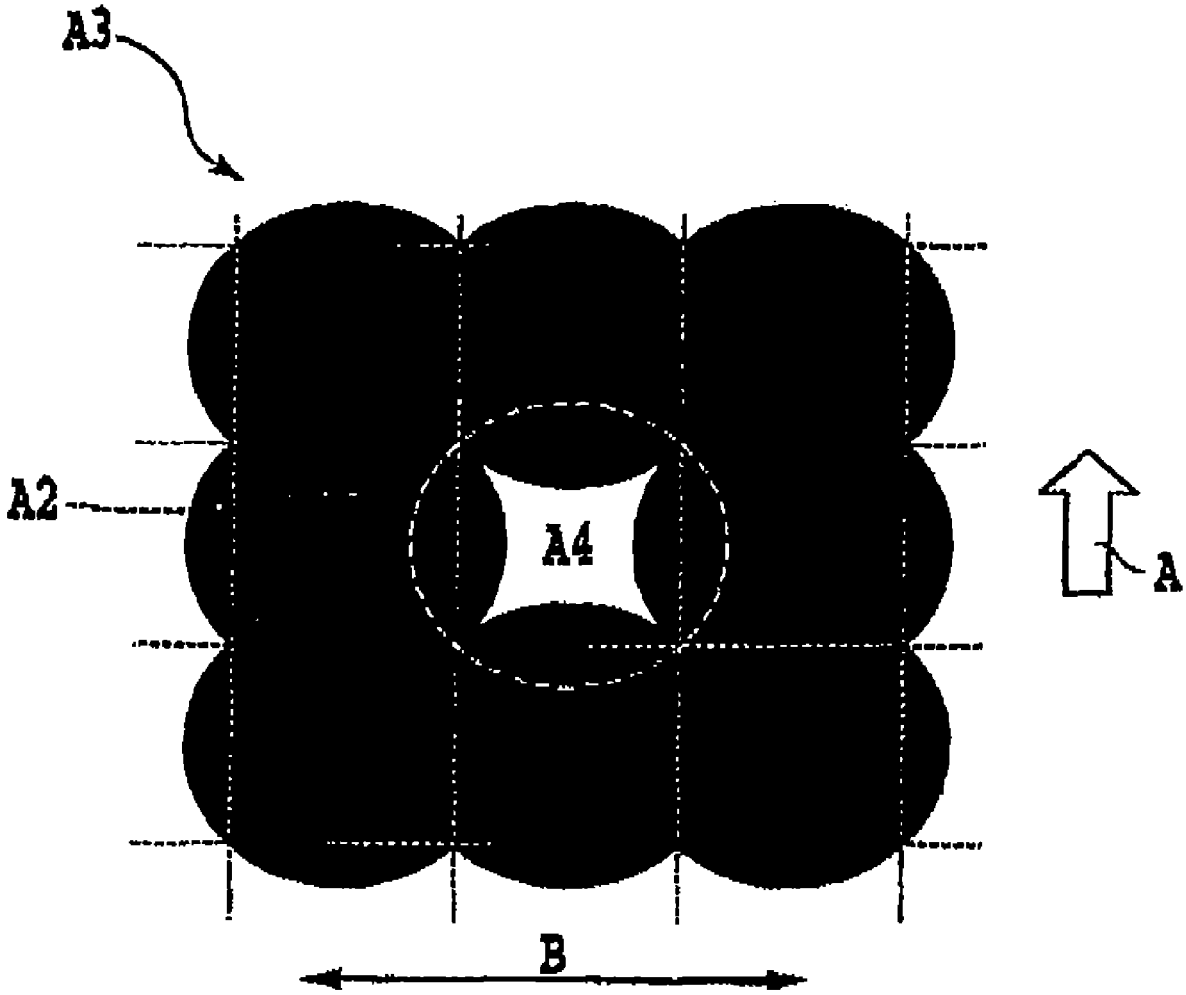
FIG. 10 is a plan view schematically showing the effects of a non-ejection nozzle on the image.

A printed image (A3) shown in FIG. 10 is formed when three print heads are used to form a continuous image in 3×3 pixels, that is, a total of nine pixels and if one of the three print heads contains one non-ejection nozzle. In this case, no image is formed in an area (A4) of the printed image (A3). However, in the image shown in FIG. 10, the area of an image (dot) formed by one ink ejection is set to be larger than that of a pixel as shown in FIG. 9. Consequently, the area (A4) in which no image is formed owing to the non-ejection nozzle is smaller than the pixel (A1). Thus, even if such an area as shown in FIG. 10 is formed, the degradation of the print quality can be minimized.

Figure 11:
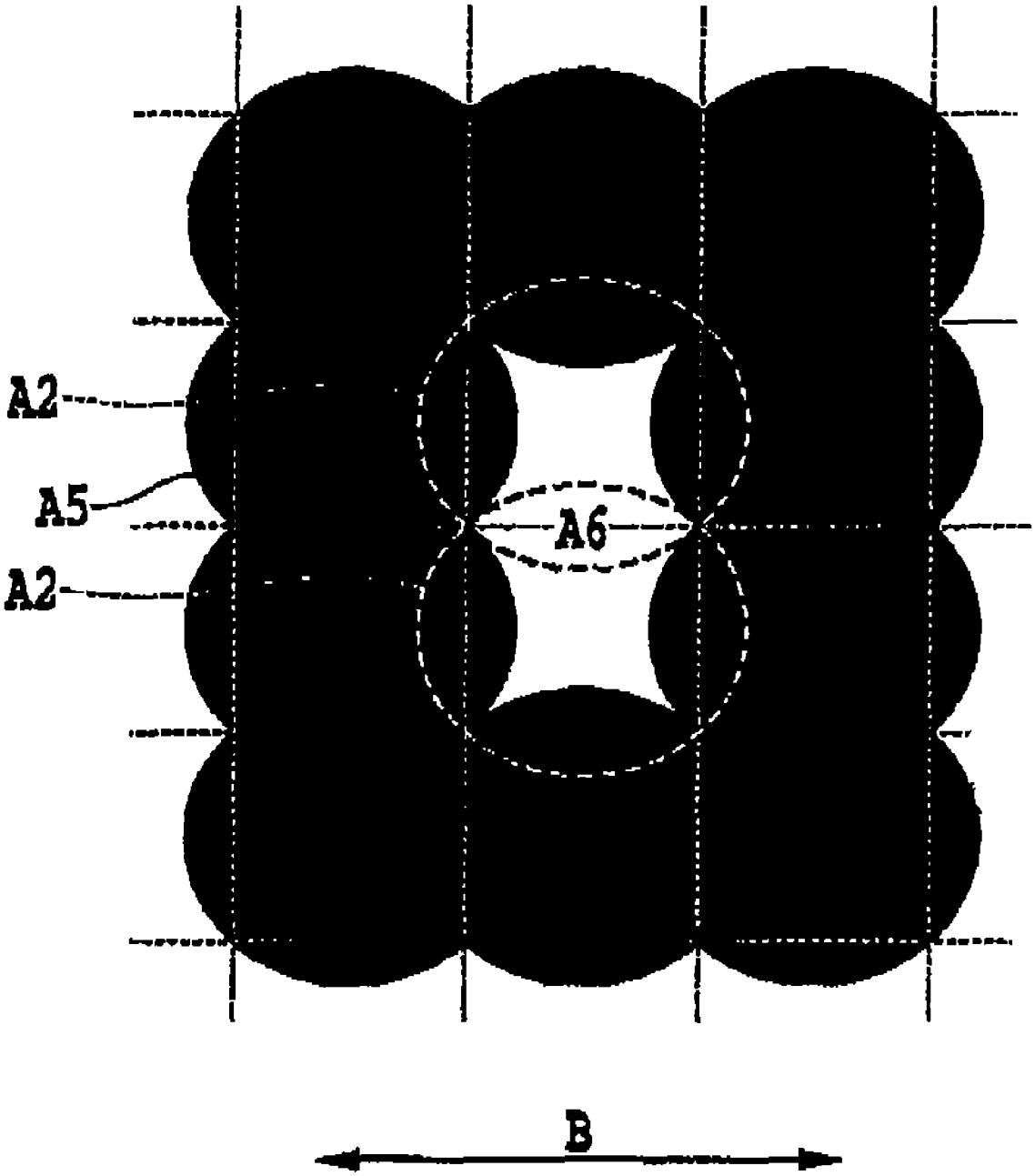
FIG. 11 is a plan view schematically showing the effects, on the image, of image formation by consecutive non-ejection nozzles in a sheet conveying direction.

However, in a plurality of print heads responsible for printing adjacent rasters, if the ink fails to be ejected through nozzles responsible for printing a plurality of pixels arranged adjacent to each other in the sheet conveying direction, no image (dot) is formed in the plurality of consecutively adjacent pixels. FIG. 11 shows that no dot is printed in two pixels arranged adjacent to each other in the sheet conveying direction. The area (A6) in which no image is formed is at least twice as large as the area (A4) formed if only one non-ejection nozzle occurs. This may significantly degrade the print quality.

Thus, in the present embodiment, if the ink fails to be ejected through the nozzles responsible for printing the pixels arranged adjacent to each other in the sheet conveying direction, the ejection order of the plurality of print heads is set to be different from a preset reference ejection order so that the pixels for which the non-ejection nozzles are responsible are not consecutively arranged in the sheet conveying direction. The ejection order is changed by the CPU 101 on the basis of information on the ejecting performance of the nozzles obtained from the non-ejection nozzle detecting device. That is, the CPU 101 also functions as ejection order changing means according to the present invention.

Figure 12:
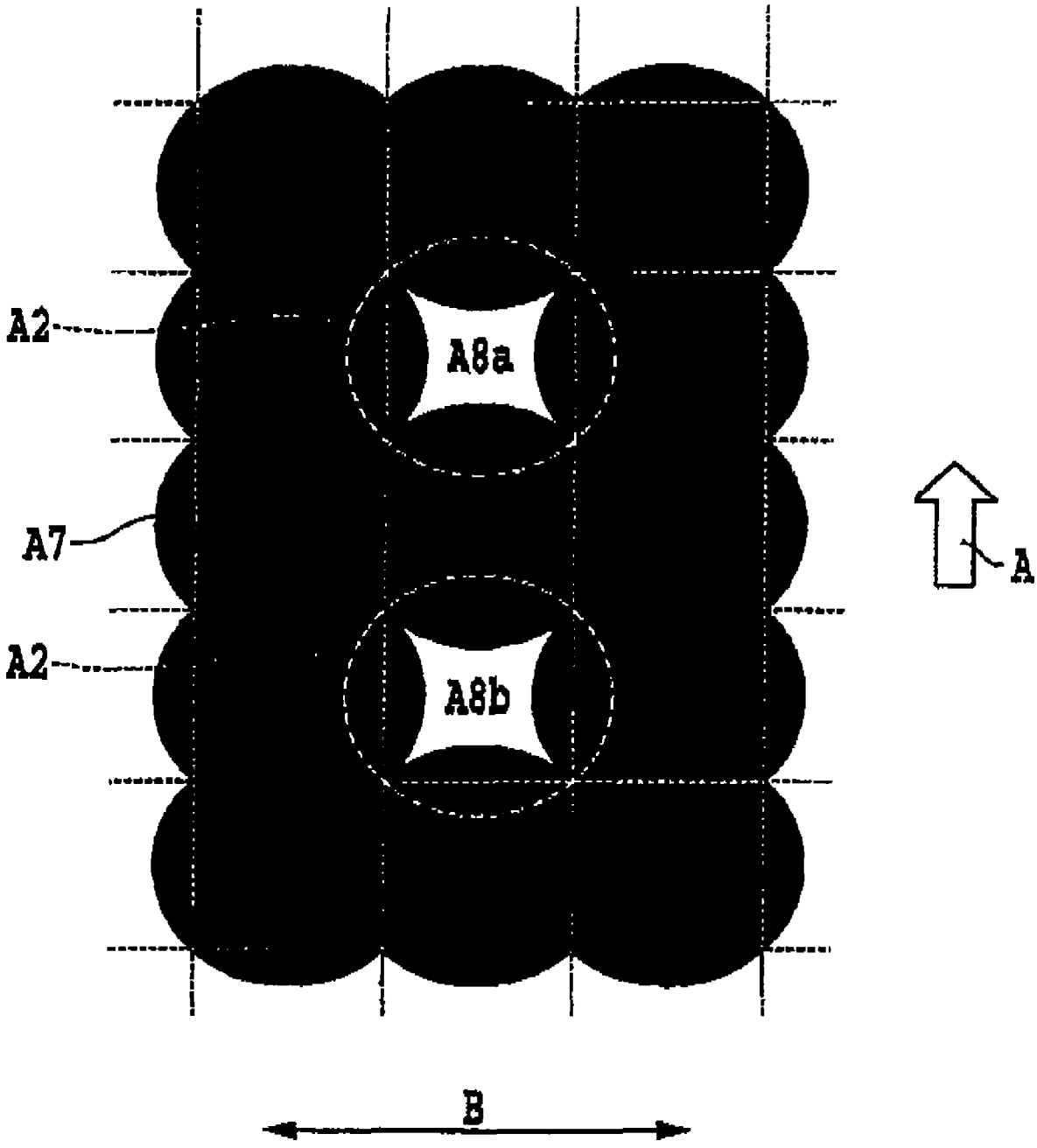
FIG. 12 is a plan view schematically showing the effects, on the image, of a change in the ejection order of print heads.

FIG. 12 schematically shows an example of an image printed by changing the ejection order of two print heads consecutively performing an ink ejecting operation if a non-ejection nozzle is present in each of the print heads and if the pixels for which the non-ejection nozzles are responsible are adjacent to each other in the sheet conveying direction. As shown in FIG. 12, areas (A8*a*) and (A8*b*) in which no image (dot) is formed owing to the two non-ejection nozzles are formed in the image. However, an image (dot) printed by a nozzle in another print head which exhibits an appropriate ejecting performance is interposed between these areas. The areas (A8*a*) and (A8*b*) are thus separated from each other. That is, the areas (A8*a*) and (A8*b*) in which no image (dot) is formed are each small like the area (A4), shown in FIG. 10.

Thus, the adverse effects of these areas on the image are minimized, inhibiting the possible degradation of the print quality.

Now, with reference to FIGS. 13 to 15, a specific description will be given of an image formed by a print head having a non-ejection nozzle.

Figure 13:
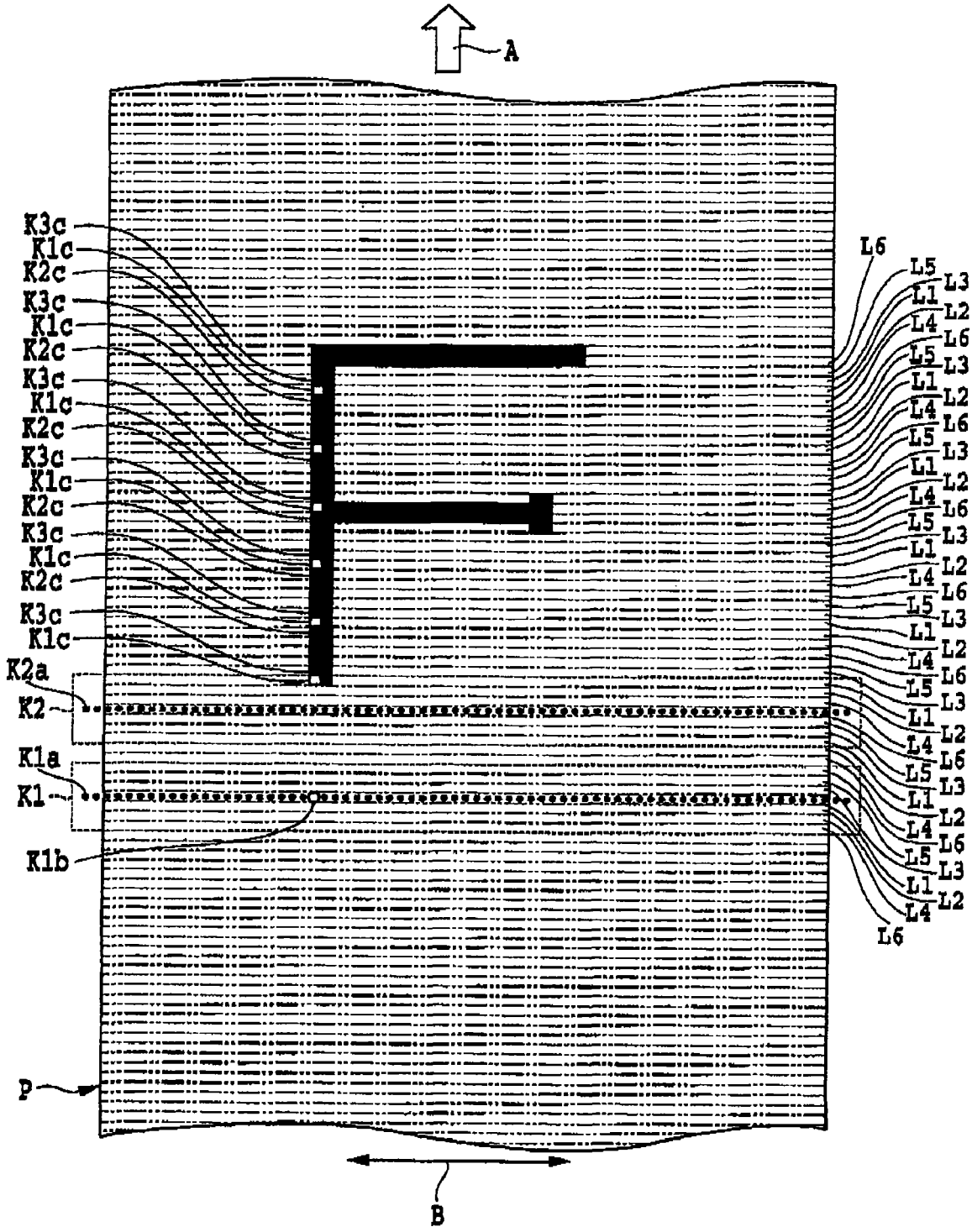
FIG. 13 is a plan view schematically showing the image formed by using the print heads showed in FIG. 3 when one of the print heads has one non-ejection nozzle.

As shown in FIG. 13, one of the print heads, the print head K1, has one non-ejection nozzle K1*b*, an image area (pixel) K10 otherwise printed by the non-ejection nozzle K1*b* is not printed. Thus, as shown in FIG. 13, an image "F" is formed which contains the pixel K1*c* having no image formed therein and provided every six raster lines. However, dots are normally printed in pixels arranged adjacent, in the sheet conveying direction (the direction of arrow A), to the area with no image formed therein. Consequently, the area K1*c* with no image formed therein is distributed, minimizing the adverse effects of the area on the actual printed image.

Figure 14:
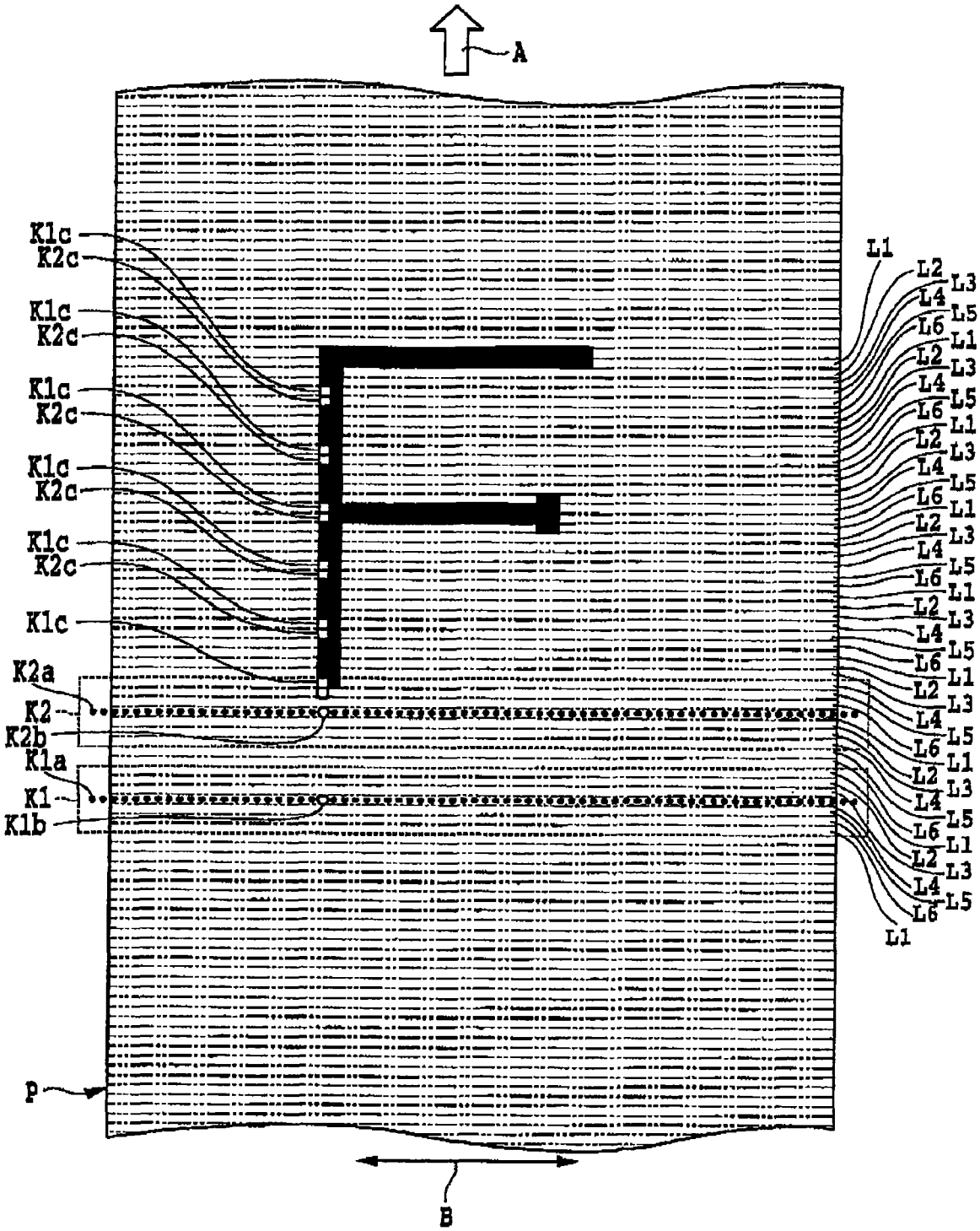
FIG. 14 is a plan view schematically showing the image formed when two nozzles responsible for printing pixels arranged adjacent to each other in the sheet conveying direction fail to perform ejection.
Figure 15:
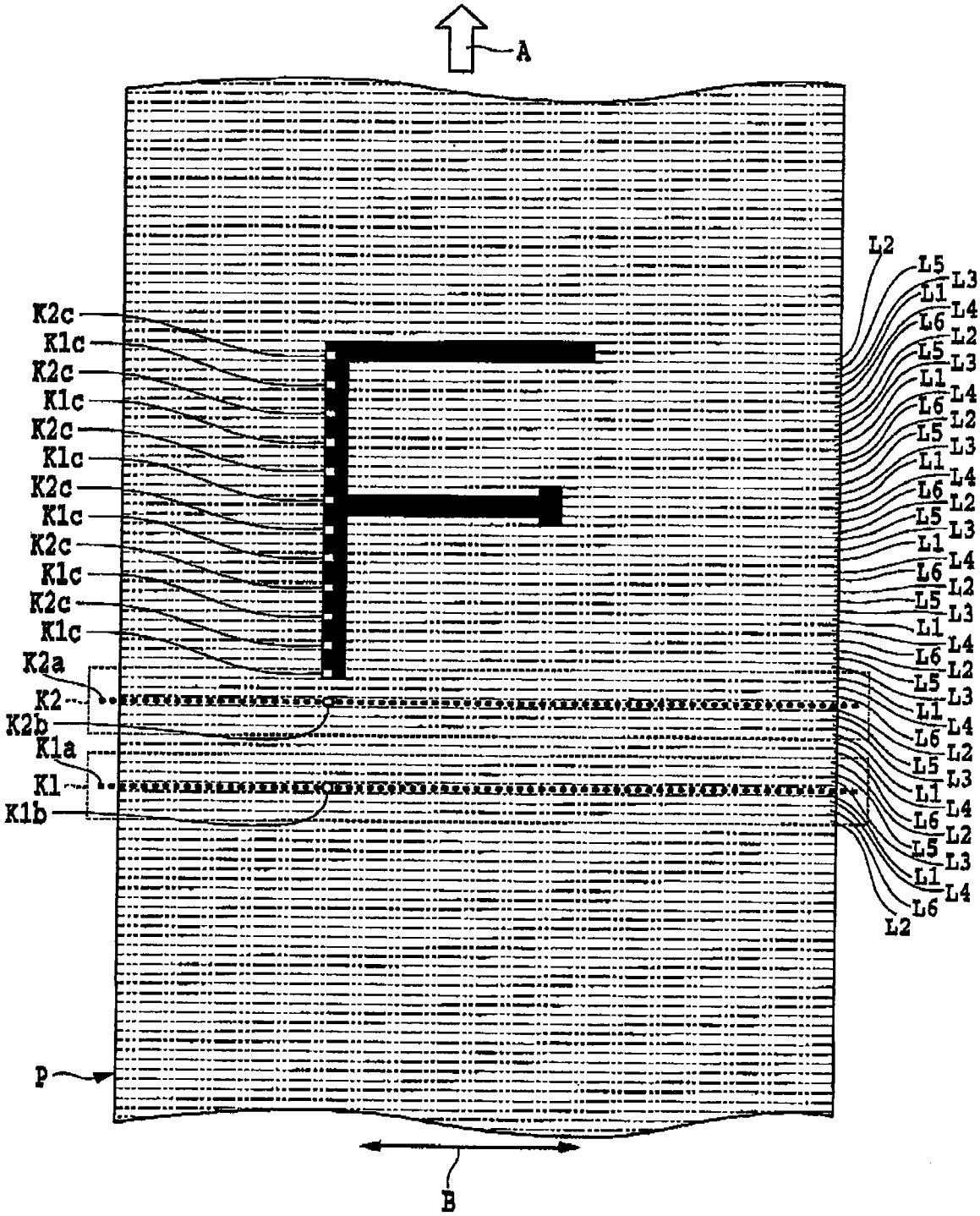
FIG. 15 is a plan view schematically showing the image formed by performing control such that the ejection order of the print heads is changed according to the present embodiment when nozzles responsible for printing pixels arranged adjacent to each other in the sheet conveying direction fail to perform ejection.

On the other hand, FIGS. 14 and 15 show an image formed if the ink falls to be ejected through nozzles responsible for two pixels arranged adjacent to each other in the sheet conveying direction.

FIG. 14 shows an image formed when conventional control is performed such that the print heads K1 to K6 eject the ink in accordance with the order in which the print heads are arranged in the sheet conveying direction. It is assumed that the print head K1 has a non-ejection nozzle K1*b*, the print head K2 has a non-ejection nozzle K2*b*, and the ejection order of the print heads eject the ink in the order of L1, L2, L3, L4, L5, and L6 (this order is repeated). In this case, in addition to the pixel K1*c*, the adjacent pixel K2*c* is not printed. Thus, the image "F" is formed which contains consecutive blank pixels as shown in FIG. 14. Thus, if consecutive pixels are not printed owing to the corresponding non-ejection nozzles, the image is significantly affected, degrading the print quality.

In contrast, in FIG. 15, showing the present embodiment, if the ink fails to be ejected from nozzles responsible for two pixels arranged adjacent to each other in the conveying direction, the ejection order of the print head containing the non-ejection nozzles is set to be different from the preset reference ejection order.

It is assumed that the reference ejection order set for the print heads K1 to K6 is L6-L4-L2-L1-L3-L5 and the non-ejection nozzle K1*b* in the print head K1 is adjacent to the non-ejection nozzle K2*b* in the print head K2. In this cane, if printing is performed with the initially set basic ejection order, neither of the two pixels arranged adjacent to each other in the conveying direction is printed owing to the non-ejection nozzles K1*b* and K2*b*. However, in the present embodiment, the ejection order of the print heads K1 to K6 is changed from the above-described basic one to L2-L6-L4-L1-L3-L5 (this order is repeated). This prevents the areas K1*b* and K2*c* not printed owing to the non-ejection nozzles K1*b* and K2*b* from being arranged adjacent to each other. The adverse effects of these areas on the printed image can thus be reduced.

As described above, in the present embodiment, a monochromatic image data stored in consecutive areas is printed using a plurality of (in the figures, six) black print heads so that each raster is assigned to one of the print heads. This prevents the ejecting performance (for example, non-ejection) unique to each of the nozzles formed in each print head from affecting areas of the image consecutively arranged in the sheet conveying direction. The ejecting performance of each nozzle is distributed for every plural rasters, drastically improving the image quality. That is, if an image is formed using one print head, the presence of a non-ejection nozzle may prevent the printing of all the image forming areas arranged in the sheet conveying direction and for which that non-ejection nozzle is responsible. This significantly degrades image quality. In contrast, in the present embodiment, even if a non-ejection nozzle in present in the print head, only a small area with no image printed therein occurs every plural rasters. This prevents the image quality from being degraded.

Moreover, if the ink fails to be ejected through all the nozzles responsible for printing the pixels arranged adjacent to each other in the sheet conveying direction, the ejection order of the print heads is changed, making it possible to avoid the consecutive arrangement of the unprinted pixels. The adverse effects of the non-ejection nozzles on the image can thus distributed. Consequently, changing the ejection order of the print heads according to the present embodiment is very effective as measures for preventing the degradation of the image quality caused by accidental inappropriate ejection through a nozzle in the print head. The reliability of the printing apparatus can be significantly improved.

Furthermore, in either cases where the ejection order set for the print heads is reference order or where the ejection order set for the print heads is changed from the reference order, the operation of ejecting the ink from each print head is always repeated at constant time intervals (in the figures, the time interval corresponds to the time required for the five print heads to perform the ink ejecting operation). That is, Thus, an excellent printing process capability can be achieved without hindering an increase in print speeds which is one of the major advantages of the configuration in which the plurality of print heads are juxtaposed in the sheet conveying direction.

In the above-described embodiment, by way of example, the detection target is a non-ejection nozzle, and the ejection order of the print heads is changed according to the detection result. However, a nozzle other than the non-ejection nozzle which may cause inappropriate ejection may be detected so that the ejection order of the print heads is changed according to the detection result. For example, the detection target may be a nozzle (defective nozzle) exhibiting ejection performance such as "deviation of landing" caused by the deviation of the ink droplets in the ejecting direction resulting in the deviation of the landing positions of the ink droplets on the print medium forward or backward or rightward or leftward, or "uneven printing" caused by a variation in the size of ink droplets. Also in this case, when the defective nozzles are consecutively arranged in the sheet conveying direction, the ejection order of the print head containing these defective nozzles is changed to prevent unprinted areas (pixels) from being consecutively arranged in the sheet conveying direction. This enables a reduction in the adverse effects of the defective nozzles on the image quality.

Furthermore, the relationship between the dots and the pixels is not limited to the one in which each dot completely fills in the corresponding pixel as shown in FIG. 9. The present invention is also effective if printing is performed in a relationship such that each dot is contained inside the corresponding pixel (a relationship such that the dot does not completely fills in the corresponding pixel).

Moreover, in the above-described embodiment, the reference ejection order of the plurality of print heads set on the assumption that no non-ejection nozzle is present is K6, K4, K2, K1, K3, and K5. However, the reference ejection order is not limited to that in the above-described example. Any order may be used provided that the print heads repeatedly perform ejection at a given period. That is, the present invention is characterized by controllably determining the ejection order of the print heads such that a plurality of nozzles exhibiting ejecting performance that may affect the printed image are prevented from being responsible for the pixels arranged adjacent to each other in the sheet conveying direction. Therefore, the reference ejection order set according to the present invention can be set regardless of the arrangement order of the print heads or the basic ejection order.

In the above-described embodiment, one nozzle array is formed in each of the plurality of print heads ejecting the ink of the same color. However, a plurality of nozzle arrays may be arranged in each of the print heads. Moreover, the present invention is applicable to a configuration that ejects ink of the same color through a plurality of nozzle arrays. The color of the ink used is not limited to black. Therefore, the present invention is also applicable to the case in which a color image is formed by ejecting inks of plural colors through the respective nozzle arrays.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-117731, filed Apr. 26, 2007, which is hereby incorporate by reference herein in its entirety.

What is claimed is:

1. An ink jet printing apparatus comprising:

a plurality of nozzle arrays arranged along a conveying direction in which a print medium is conveyed, each of the nozzle arrays having a plurality of nozzles which are arranged in a crossing direction crossing the conveying direction and through which ink droplets are ejected, the apparatus sequentially printing an image in a plurality of raster forming areas set on the print medium in the crossing direction by sequentially performing, array by array, an operation of ejecting ink through the plurality of nozzle arrays; and ejection order changing means for changing an ejection order of the plurality of nozzle arrays according to ejecting performance of each of the nozzles included in each of the nozzle arrays.

2. The ink jet printing apparatus according to claim 1, wherein the raster forming area is an area in which a plurality of pixels are arranged, each of the pixels being an area on the print medium which is printed by an ink droplet ejected through one nozzle.

3. The ink jet printing apparatus according to claim 2, further comprising ejecting performance detecting means for detecting the ejecting performance of each of the nozzles, wherein the ejection order changing means changes the ejection order of the nozzle arrays on the basis of the ejecting performance of each of the nozzles in each of the nozzle arrays detected by the ejecting performance detecting means.

4. The ink jet printing apparatus according to claim 3, wherein the ejecting performance detecting means has a light sensor that receives light from each pixel for which the corresponding one of the nozzles in each of the nozzle arrays is responsible, the light sensor outputting a signal corresponding to a quantity of light received, and the detecting means detects the ejecting performance of each of the nozzles on the basis of an output from the light sensor.

5. The ink jet printing apparatus according to claim 1, wherein the ejection order changing means changes the ejection order of the plurality of nozzle arrays from a preset reference ejection order to an ejection order that is different from the reference ejection order, according to the ejecting performance of each of the nozzles contained in each of the nozzle arrays.

6. The ink jet printing apparatus according to claim 5, wherein when the preset reference ejection order is used, if a plurality of nozzles responsible for printing a plurality of pixels arranged adjacent to each other in the conveying direction are defective and fail to exhibit a predetermined ejecting performance, the ejection order changing means sets the ejection order of the nozzle array including the defective nozzles to be different from the reference ejection order.

7. The ink jet printing apparatus according to claim 6, wherein the reference ejection order is set to be the same as an order in which the nozzle arrays are arranged in the crossing direction.

8. The ink jet printing apparatus according to claim 6, wherein the reference ejection order is set to be different from the order in which the nozzle arrays are arranged in the crossing direction.

9. The ink jet printing apparatus according to claim 6, wherein the different ejection order is such that the raster forming areas printed by the nozzle arrays including the defective nozzles are not adjacent to each other in the conveying direction.

10. The ink jet printing apparatus according to claim 8, wherein the different ejection order is such that the raster forming areas printed by the nozzle arrays including the defective nozzles are not adjacent to each other in the conveying direction.

11. The ink jet printing apparatus according to claim 1, wherein the defective nozzles fail to allow ink droplets to land on corresponding pixels.

12. The ink jet printing apparatus according to claim 1, wherein the defective nozzles include a non-ejection nozzle that fails to eject an ink droplet.

13. The ink jet printing apparatus according to claim 1, wherein the defective nozzles include a defective nozzle that falls to eject an ink droplet in a preset direction.

14. An ink jet printing method using a plurality of nozzle arrays arranged along a conveying direction in which a print medium is conveyed, each of the nozzle arrays having a plurality of nozzles which are arranged in a crossing direction crossing the conveying direction and through which ink droplets are ejected, the method sequentially printing an image in a plurality of raster forming areas set on the print medium in the crossing direction by sequentially performing an operation of ejecting ink through the plurality of nozzle arrays, wherein an ejection order of the plurality of nozzle arrays is changed according to ejecting performance of each of nozzles included in each of the nozzle arrays.

* * * * *